US005642598A

United States Patent [19]

Cannaverde

[11] Patent Number: 5,642,598

[45] Date of Patent: Jul. 1, 1997

[54] COLLATION FEEDING MECHANISM FOR ENVELOPE INSERTING MACHINE

[75] Inventor: Joseph A. Cannaverde, Seymour, Conn.

[73] Assignee: Pitney Bowes Inc., Stamford, Conn.

[21] Appl. No.: 577,674

[22] Filed: Dec. 26, 1995

[51] Int. Cl.[6] ..... B65B 43/26; B65B 39/00

[52] U.S. Cl. ..... 53/284.3; 53/381.5

[58] Field of Search ..... 53/460, 284.3, 53/459, 475, 381.5, 381.7, 255

[56] References Cited

U.S. PATENT DOCUMENTS

| | | | |
|---|---|---|---|
| 3,936,993 | 2/1976 | Dorer | 53/284.3 |
| 4,852,334 | 8/1989 | Auerbach | 53/284.3 X |
| 4,888,938 | 12/1989 | Auerbach | 53/284.3 X |
| 4,962,623 | 10/1990 | Francisco | 53/284.3 X |
| 5,081,825 | 1/1992 | Mrozinski | 53/284.3 X |
| 5,191,751 | 3/1993 | Marzullo et al. . | |
| 5,327,705 | 7/1994 | DeFigueriedo | 53/284.3 X |
| 5,447,015 | 9/1995 | Belec et al. | 53/284.3 X |

*Primary Examiner*—Horace M. Culver

*Attorney, Agent, or Firm*—Charles R. Malandra, Jr.; Melvin J. Scolnick

[57] ABSTRACT

An envelope inserting machine is disclosed which includes means for ensuring that very thin collations, down to a single sheet folded sheet, are consistently accurately inserted into envelopes held at an inserting position with the throats of the envelopes held open. The inserting machine includes an inserting means which feeds successive envelopes to an inserting position and holds the envelopes thereat with the throats open, and a feeding means for the collations feeds the collations into the envelopes while maintain a grip thereon until the insertions are fully inserted into the envelopes, so that the feed means maintains control over the collations until they are fully inserted into the envelopes.

10 Claims, 3 Drawing Sheets

COLLATION FEEDING MECHANISM FOR ENVELOPE INSERTING MACHINE

BACKGROUND OF THE INVENTION

The present invent relates generally to the field of envelope inserting machines, and more particularly to a novel collations feeding mechanism for feeding collations of varying thickness into envelopes.

Envelope inserting machines have long been well known, and a large variety of such machines are commercially available. In general, these machines store a batch of envelopes in a storage and feeding device, and feed envelopes seriatim to an inserting position at which packets of insert material, usually referred to as collations, are inserted into successive envelopes, the flaps thereof having been opened during movement from the storage device to the inserting position, and the throats of the envelopes having been opened when the envelopes reach the inserting position. After the envelopes have received the collations, which may be of varying thickness they are fed through devices which closed the envelope flaps and seal them, after which they are typically fed to a mailing machine which affixes appropriate postage to the envelopes and they are then stacked for further handling.

There are typically two different methods employed for inserting a collation into an envelope, one being a reciprocating pusher mechanism in which a pushing device engages the trailing edge of a collation and pushes it into an envelope held at an inserting position. The other method involves a rotary feeding mechanism, such as a plurality of opposed cooperating roller sets, opposed cooperating endless conveyor belts or one conveyor belt with an opposed cooperating back up roller, all of which run continuously in the same direction to feed successive collations along a feed path, at the end of which the collations are inserted into envelopes directly from the last cooperating roller set or the end of the conveyor belts or belt and last back up roller, as the case may be. Both systems are widely used and each has advantages and disadvantages, but generally speaking the reciprocating pusher mechanisms are utilized more in smaller, low to medium volume envelope inserting machines, while the rotary mechanisms are utilized more in large size high volume inserting machines. The reason for this is principally that this type of feeding mechanism is better suited to the high speed operation that is typically involved in the large high volume inserting machines. Generally speaking, these feeding mechanism work quite well, and both types have met with considerable commercial success in their respective preferred environments.

One serious drawback of the rotary mechanisms usually associated with high volume inserting machines is that the feeding mechanism is virtually incapable of inserting a single sheet, and with less frequency even two or possibly three sheets, of paper into an envelope due to the physical shape and size of the parts of the feeding device adjacent to the throat of the envelope. The reason for this that in the typical arrangements of these heretofore known rotary feeding mechanisms, the last roller set, or the end of the conveyor belts or belt and last back up roller, as the case may be, is spaced somewhat from the throat of the envelope disposed at the inserting position. Thus, depending on the specific shape of these parts, the collation is firmly gripped by the opposed roller sets or by the conveyor belts or belt and back up roller through its path of movement as it approaches the throat of an envelope, and even as the collation is partially inserted into the envelope. However, because the terminal parts of the rotary feeding mechanisms cannot physically reach into the open envelope, the grip thereof on the collation is released before the collation is fully inserted into the envelope, thereby leaving the collation to move further into the envelope under its own momentum.

It will be apparent that this is not a problem with the reciprocating pusher type collation feeding mechanisms, since the collation is literally pushed into the envelope until it is fully inserted therein and the leading edge of the collation is disposed at the bottom of the envelope. However, with regard to the rotary mechanisms, the loss of positive gripping contact between the feeding mechanism and the collation before the collation is fully inserted into the envelope presents a serious problem when the collation consists of only one sheet, and possibly two or three sheets, depending on the nature of the paper, because there is insufficient inertia in a single sheet, or in so few sheets, to maintain the momentum necessary to move the collation fully into the envelope. The collation stops with a small trailing edge portion thereof projecting above the crease line between the front surface and the flap of the envelope.

This typically causes any one or more of a number of problems. One is that when the envelope flap is closed during further movement of the envelope, it creates a short fold in the insert material, usually at an intermediate location on the sheet when it is opened, which fold is undesirable because it tends to destroy the otherwise neat appearance of previously folded sheets. Another problem is that the small trailing edge portion of the collation may be too thick to fold in response to the envelope flap being closed, in which case the flat may fold at some point other than the normal crease line between the flap and the front wall of the envelope. This results in a short flap, which will not properly engage the rear wall of the envelope, and may, during the sealing process, seal to the portion of the collation that is projecting above the rear wall of the envelope. This situation present obviously unacceptable results when the envelope is opened and an attempt is made to remove the insert. A still further problem is that either the short folded portion of the collation or the folded flap, as the case may be, may cause the envelope to jam, either in the ejection mechanism of the inserting machine or in other processing apparatus through which the envelope may be fed in the course of further processing, thereby causing down time while an operator clears the jammed envelope from the equipment. It will be apparent that all of these problems are unacceptable if an inserting machine is utilized to feed one or a just a few sheets with any degree of frequency and yet remain commercially viable.

Thus, there is a need for a continuously operating rotary feeding mechanism of the types above described which is capable of feeding collations consisting of either one or a very few number of sheets into envelopes with the same degree of consistent reliability as these mechanisms now feed collations consisting of many sheets of insert material.

SUMMARY OF THE INVENTION

The present invention substantially overcomes if not entirely eliminates the foregoing disadvantages and drawbacks of presently available rotary mechanisms for envelope inserting machines by providing a structure in which this type of feeding mechanism maintains positive grip control on a collation until the collation has been fully inserted into an envelope with the trailing edge of the collation at or below the crease line between the flap and front wall of the envelope. The present invention provides a unique construction in which the terminal portion of a cooperating roller sets or conveyor belt and back up roller type feeding mechanism is disposed partly within the throat of an envelope so that the feeding mechanism does not release positive grip control on the collation until the leading edge thereof is fully inserted to the bottom of the envelope, thus ensuring that the trailing edge of the insert is at or below the flat crease line of the envelope.

In its broader aspects, the invention comprises an envelope inserting machine for inserting collations of varying thickness into successive envelopes fed seriatim to a predetermined inserting position and held thereat with the throat of the envelopes open, each envelope having a front wall, a back wall and a flap secured to the upper edge of the front wall along a crease line. Within this environment, the inserting machine comprises means for positioning successive envelopes at the predetermined inserting position with the crease line disposed at a predetermined location, means at the inserting position for opening the throat of each successive envelope fed to the inserting position, and rotary feeding means for feeding successive collations of varying thickness to the inserting position and for inserting the collations into the envelopes while maintaining a grip on the collations until the collations are fully inserted into the envelopes with the trailing edge of the collations disposed at or beyond the crease line of the envelopes, whereby the collations will be fully inserted into the envelopes regardless of whether the collations consist of one or a plurality of sheets.

In some of its more limited aspects, the rotary feeding means includes opposed cooperating rotary feed elements disposed adjacent the predetermined location of the crease line when an envelope is disposed in the predetermined inserting position for contacting opposite surfaces of the collation for gripping the collation therebetween until the trailing edge thereof have reached the crease line. In a presently preferred embodiment, the opposed cooperating rotary feed elements comprise an endless belt having a run portion extending along the feed path, and support means for supporting the run portion such that the run portion terminates adjacent the predetermined location of the crease line. The opposed cooperating rotary feed elements further comprise rotary back up means for the run portion of the belt mounted in cooperating relationship with the run portion where the run portion terminates at the predetermined location of the crease line. The support means for supporting the termination point of the run portion of the belt comprises a roller mounted for limited movement toward and away from the rotary back up means, and means normally urging the roller toward the rotary back up means, whereby the termination point of the belt can yieldably move to accommodate collations of varying thickness. The rotary back up means comprises a roller against which the run portion of the belt urges the collation in feeding engagement therewith, the axes of the back up roller and the belt supporting roller being in substantial alignment with each other adjacent the predetermined location of said crease line. Thus, the arraignment is such that the cooperating belt and roller, at the termination point of the run portion of the belt, retain positive control over a collation gripped therebetween until the trailing edge of the collation reaches the crease line, thereby ensuring that the entire collation is inserted into the envelope before this control is released.

Having briefly described the general nature of the present invention, it is a principal object thereof to provide an envelope inserting machine for inserting collations of varying thickness into successive envelopes having features of construction that ensure that the collations are fully inserted into the envelopes regardless of the thickness of the collations.

Another object of the present invention is to provide an envelope inserting machine of the type described in which the feeding structure for feeding the collations into the envelopes maintains positive grip control over the collations until they are fully inserted into the envelopes so that the collations are positively driven to their final position in the envelopes.

Still another object of the present invention is to provide an envelope inserting machine of the type described in which the nature of construction of the collation feeding elements adjacent the throat of the envelopes is such that the last point of contact between the feeding elements and the collations is disposed substantially at the crease line between the front wall and flap of an envelope so that the collations are fully inserted into the envelope while still under the control of the collation feeding elements.

These and other objects and advantages of the present invention will be more apparent from an understanding of the following detailed description of presently preferred modes of carrying out the invention when considered in conjunction with the accompanying drawings.

DETAILED DESCRIPTION OF THE INVENTION

Figure 1:
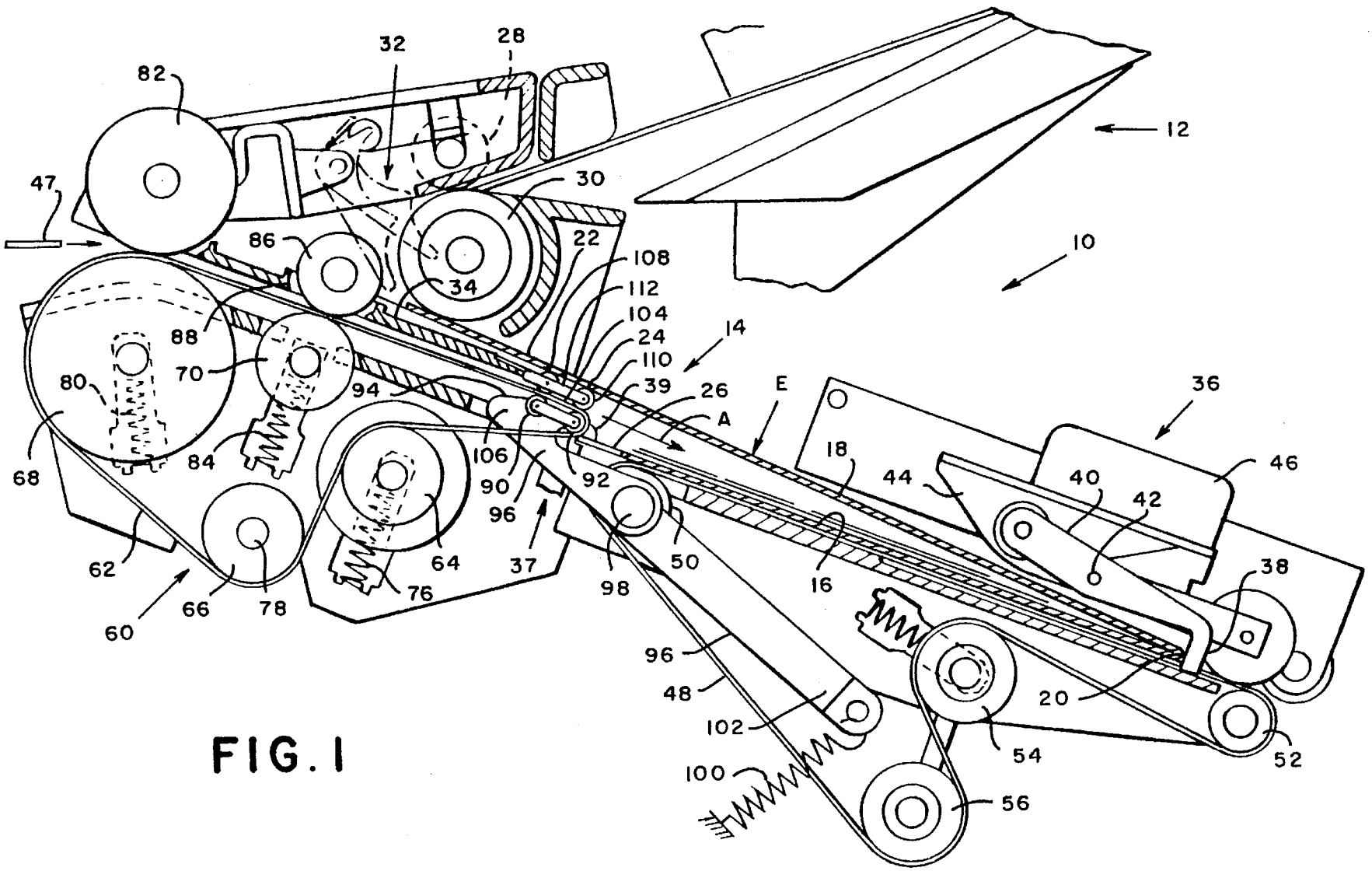
FIG. 1 is a side sectional view through an envelope inserting machine of the present invention utilizing the novel rotary collation inserting mechanism.
Figure 2:
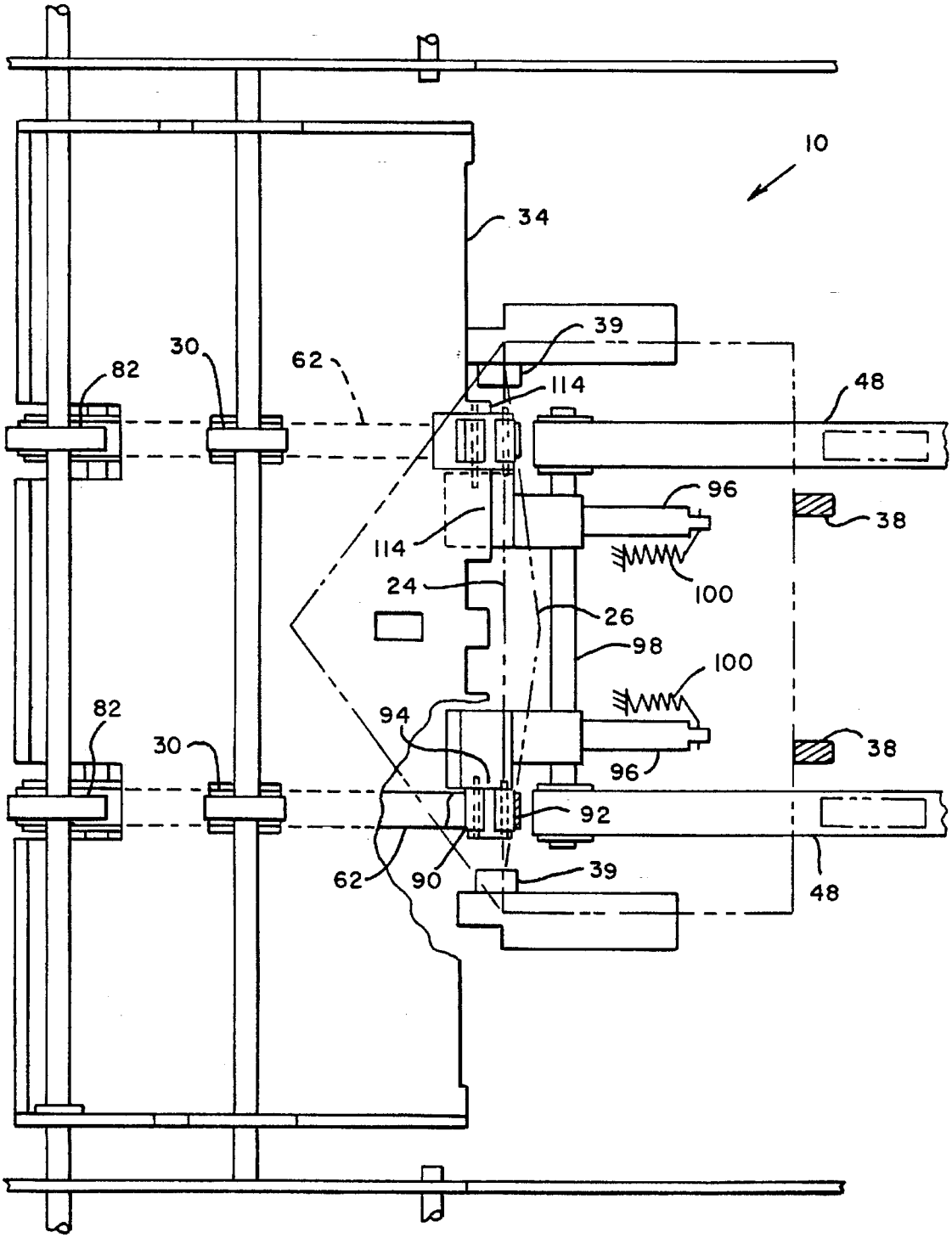
FIG. 2 is a plan view of the envelope inserting machine shown in FIG. 1, with portions removed to reveal details of the invention, and showing an envelope in the predetermined collation inserting position.

With reference now to the drawings, and particularly to FIGS. 1 and 2 thereof, the envelope inserting machine of the present invention is therein designated generally by the reference numeral 10. It should be understood that envelope inserting machines of the type in which the present invention resides are commercially available and therefore have long been well known. Thus, throughout the following description and in the accompanying drawings, only so much structure is described and shown as is necessary for a complete understanding of the present invention. It should also be understood that the inserting machine 10 has suitable side plates and other frame elements to which all of the parts described below are suitably attached.

As seen in FIG. 1, the envelope inserting machine 10 comprises an envelope feeding component, designated generally by the reference numeral 12, for positioning successive envelopes at a predetermined inserting position, designated generally by the reference numeral 14. As is well known, envelopes of the type used with the inserting machine 10 comprise a back wall 16, a front wall 18 joined to the back wall 16 at the bottom 20, and a flap 22 joined to the front wall 18 along a crease line 24. As best seen in FIG., the upper edge of the back wall 16 is cut away so that the height of the back wall 16 across a portion of the length of the envelope E is less than the height of the front wall 18, thereby forming a recess 26 which extends substantially across the length of the envelope E and downwardly toward the bottom 20 of the envelope. The recess 26 may have different configurations from one style of envelope to another, such as a V, a partial V with a flat central portion, a gradual curve, etc., but some form of recess 26 must be present for a purpose hereinafter made clear.

Any suitable envelope feeding component 12 may be utilized with the present invention, a number of which are well known in the art and therefore need not be further described or shown in detail. Envelopes are suitably stored in the feeding component 12 in a stack with the flaps 22 closed. Each envelope is fed bottom first to the insert receiving position 14 along a reverse feed path defined first by a pair of opposed feed rollers 28 and 30 which feed the envelope to a pivotally mounted envelope flap stripper designated, generally by the reference numeral 32, and then around the feed roller 30 until the bottom 20 of the envelope E reaches the upper edge of a guide plate 34 which directs the envelope further toward the insert receiving position 14. The flap stripper 32 catches the upper edge of the flap 22 and opens it as the envelope moves around the feed roller 30 so that when the envelope E reaches the insert receiving position 14 the flap 22 is fully opened. Suitable urging springs and/or other back up rollers (not shown) maintain the flap 22 in contact with the feed roller 30 until the bottom 20 of the envelope E is in the predetermined inserting position. When the envelope E reaches this position, as determined by a suitable stop mechanism, indicated generally by the reference numeral 36 and more fully described below, a pair of envelope throat opening devices, designated generally by the reference numeral 37, open the throat of the envelope by means of hooks 39 which travel in an orbital path to engage the upper edge of the rear wall 16 of the envelope E and pull it downwardly to provide sufficient space between the rear wall 16 and front wall 18 for a collation of maximum thickness to enter the envelope E. Throat opening devices of the type used in the inserting machine 10 are also well known in the art and are commercially available and therefore need not be further described or shown for a complete understanding of the present invention.

As previous mentioned, the insert receiving position 14 for the envelope E is determined by the stop mechanisms 36, each of which includes an abutment arm 38 formed on the end of a lever 40 which is suitably pivotally mounted as at 42 to the housing 44 of a solenoid device 46 which is effective in known manner to raise the lever 40 by an amount necessary to permit the envelope E with the insert material therein to pass under the bottom of the abutment member 38. The operation of the solenoid 46 is appropriately timed with the operation of the insert material feeding mechanism and an envelope ejection mechanism, both hereinafter described, so that the envelope E cannot move beyond the insert receiving position 14 until the insert material is fully inserted into the envelope E. After the collation 47, which may be just a single sheet of folded paper as seen at the left end of FIG. 1, is fully inserted into the envelope E, as further described below, it can be conveyed away from the insert receiving position 14 by an ejection mechanism which comprises at least one and preferably a pair of feeding belts 48 which pass around pairs of rollers 50, 52, 54 and 56 in known manner to eject the filled envelope E from the envelope inserting machine 10. A back up idler roller 57 is mounted on the end of each of the levers 40 opposite the abutment member 38 so that when the lever 40 rocks about the pivot 42 to raise the abutment member 38, the roller 57 presses the envelope E with the collation therein against the feed belts 48 to eject the envelope E from the inserting machine 10. It should be noted that the position of the abutment member 38 is suitably adjustable in the direction of movement of the envelope to accommodate for envelopes of different depth, since the insert receiving position is fixed, as will be more apparent hereinafter.

Still referring to FIGS. 1 and 2, it will be seen that the collation 47 is suitably fed toward the envelope inserting machine 10 and is received by a rotary collation feeding mechanism, indicated generally by the reference numeral 60. The collation feeding mechanism 60 includes at least one and preferably a pair of feeding belts 62 which extend around a plurality of pulleys 64, 66, 68 and 70. The pulley 64 is spring biased by a suitable spring mechanism 76 to apply sufficient tension on the belt 62 to maintain driving engagement between the belt 62 and the pulley 66, which is mounted on a driven shaft 78 so as to drive the belt 62, the spring biased pulley 64 also functioning to keep the belt 62 sufficiently taut to move the collations 47 as further described. The pulley 68 is spring biased by a suitable spring mechanism 80 toward a back up roller 82 so that an incoming collation 47 is gripped in driving relationship between the belt 62 passing around the pulley 68 and the back up roller 82. The roller 70 is also spring biased by another suitable spring mechanism 84 toward a back up roller 86 so that the collation 47 is gripped in driving relationship between the belt 62 and the back up roller 86. through a suitable aperture 88 in the guide plate 34.

Figure 3:
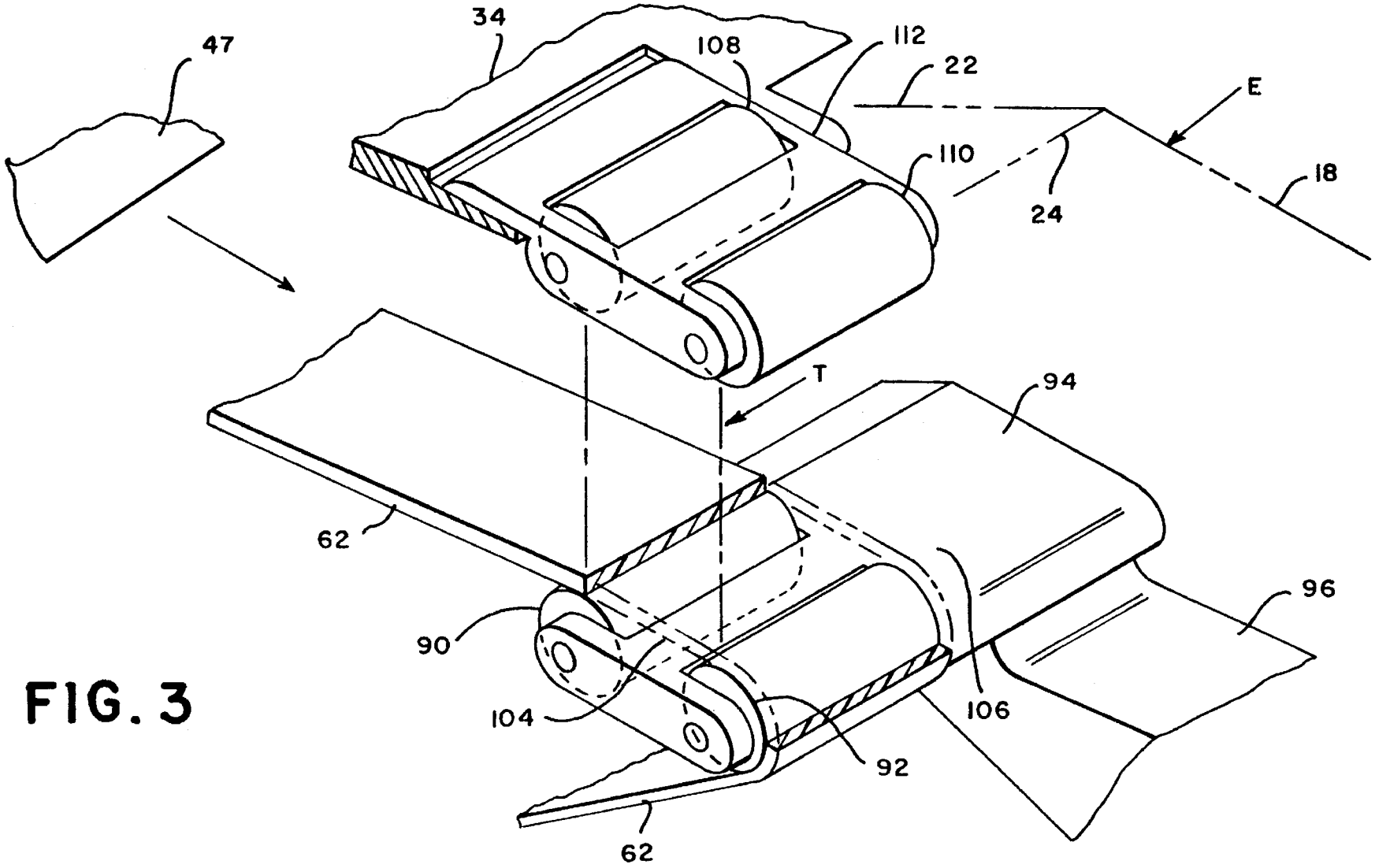
FIG. 3 is an exploded, perspective view of the terminal portion of the rotary collation feeding mechanism that inserts the collations fully into the envelope.

With reference to FIGS. 1 and 3, the rotary feeding mechanism 60 further includes a pair of relatively small diameter pulleys 90 and 92 which are rotatably mounted on one end 94 of a lever 96 which is pivotally mounted on a shaft 98, the end 94 of the lever 96 being urged in a clockwise direction about the shaft 98 by a tension spring 100 connected between the other end 102 of the lever 96 and a suitable portion of the frame of the inserting machine 10. The belt 62 passes over the upstream pulley 90 and around the downstream pulley 92 to define a short run portion 104 of the belt 62 which extends between the pulleys 90 and 92. It will be seen that the lever 96 adjacent the end 94 is formed with a suitable upwardly extending portion 106 on which the rollers 90 and 92 are mounted so as to in substantial alignment with the path of movement, represented by the arrow A, of a collation into the envelope E, which in turn causes the short run portion 104 of the belt 62 to also be in substantial alignment with the path of movement of the collation 47.

A pair of rollers 108 and 110 of substantially the same relatively small diameter as the pulleys 90 and 92 are rotatably mounted on a generally rectangular frame 112 which is mounted on side portions 114 of the guide plate 34 adjacent the downstream end thereof. These rollers 108 and 110 are positioned so as to be in opposed relationship to the pulleys 90 and 92 to grip a collation 47 between the rollers 108 and 110 and the upper run 104 of the belt 62 between the pulleys 90 and 92. It will be apparent that if a thick collation, typically packet of insert material up to about one quarter inch in thickness, is fed through the collation feeding mechanism 60, the upper run 104 of the belt 62 can move downwardly as the result of limited rotation of the lever 96 about the shaft 98, and the tension spring 100 will yield to permit this rotation and still maintain sufficient driving force between the upper run 104 of the belt 62 and the rollers 108 and 110. It should be remembered, however, that the principal objective of the collation feeding mechanism 60 is to effectively insert collations of just one or a very few sheets.

It will be apparent that the diameters of the pulleys 90 and 92 and the rollers 108 and 110 is such that the combined vertical height of the pulley 92, the roller 110 and the belt 62 therebetween is substantially equal to the width of the throat of the envelope E at the point where the hooks 39 have opened the throat. It must be understood that the construction and arrangement of the described parts is such that when the envelope E is in the insert receiving position 14 as determined the position of the adjustable abutment member 38, the crease line 24 of the envelope is in approximate vertical alignment with the axes of the downstream roller 110 and the downstream pulley 92, and the assembly consisting of the upstream roller 108 and upstream pulley 90, the portion the frame 112 between the rollers 108 and 110 and the upper run 104 of the belt 62 is positioned in underlying relationship with the flap 22 adjacent to the crease line 24. Therefore, the point of tangency, indicated by the letter T, between the belt 62 and the downstream roller 110 is also in approximate vertical alignment with the axes of the roller 110 and pulley 92, which also places the point of tangency T in approximate vertical alignment with the crease line 24. Since the belt 62 and the downstream roller 110 maintain a positive grip on a collation 47 until the trailing edge thereof reaches the point of tangency T, it will be apparent that this positive grip is also maintained until the collation 47 has been inserted into the envelope E until the trailing edge thereof is at least at the crease line or beyond, depending on whether the height of the collation 47 is equal to or less than the height of the envelope E. In either event, so long as the trailing edge of the collation 47 reaches the crease line 24, the collation will have been fully inserted into the envelope. It should be understood that the phrase "approximate vertical alignment" is intended to mean that the envelope E is positioned such that the crease line 24 is either in precise vertical alignment with the axes of the downstream roller 110 and pulley 108, or is slightly upstream of the roller 110 and pulley 108 so that the point of tangency T is either at the crease line 24 or slightly within the envelope E. This ensures that the trailing edge of the collation 47 will be either at the crease line 24 or slightly within the envelope when the belt 62 and the roller 110 release positive grip on the collation.

From the foregoing description, it is believed that the operation of the envelope inserting machine 10 is fairly apparent. An envelope E is fed bottom first by the envelope feeding component 12 to the feed roller 30 and the flap stripping device 32 which opens the flap 22 as the envelope E is fed around the feed roller 30 to the upper surface of the guide plate 34, after which the envelope is fed along the upper surface of the guide plate 34 until the bottom 20 contacts the abutment member 38. The longitudinal position of the lever 40 has been previously longitudinally adjusted to position the abutment member 38 so that when the bottom 20 of the envelope E contacts the abutment member 38, the crease line 24 of the envelope is in approximate vertical alignment with axes of the downstream roller 110 and pulley 92. The envelope E is then in the predetermined insert receiving position 14 since the position of the abutment member 38 has been appropriate adjusted for the depth of the envelopes being utilized. At this point, the hooks 39 of the throat opening devices 37 engage the upper edge of the back wall of the envelope E and pull downwardly thereon to open the throat of the envelope. Through appropriate microprocessor controls, the collation 47 is then fed to the collations feeding mechanism 60 where it is initially engaged between the belt 62 and the back up roller 82, which feed the collation forward until it is engaged between the belt 62 and the backup roller 86, and then the belt 62 and the rollers 108 and 110.

As best seen in FIG. 3, the belt 62 and the respective back up rollers 82, 86, 108 ad 110 continue to feed the collation 47 forward until the trailing edge of the collation reaches the end of the nip of the belt 62 and the roller 110 which, as explained above, is in approximate vertical alignment with the crease line 24. If it is assumed, for the purpose of illustration, that the envelopes being utilized are three inches in depth from the crease line 24 to the bottom 20, it is apparent that the collations 47 must be no greater than three inches in height in order to fit properly into the envelope. If it is again assume that the collations 47 are three inches in height, it will be apparent that the leading edge of the collation will be disposed at the bottom 20 of the envelope when the trailing edge is released from the grip of the belt 62 and the roller 110, thereby ensuring that the collation 47 is fully inserted into the envelope E. If, on the other hand, the collation 47 is slightly less than three inches, e.g., two and three quarters inches, the trailing edge of the collation will still be at the crease line 24 and therefore effectively fully within the envelope E when it is released from the grip of the belt 62 and the roller 110, even though the leading edge of the collation 47 will still be disposed one quarter inch short of the bottom 20 of the envelope, or less if the collation has sufficient momentum to carry it forward for another small fraction of an inch. In either event, the collation will still be entirely within the envelope so that no portion thereof can project above the crease line 24 to interfere with subsequent folding and sealing of the flap 22.

Once the collation 47 has been fully inserted into the envelope, the aforementioned microprocessor that controls the timing of the various operational steps of the inserting machine 10 causes the lever 40 to rock in a counter clockwise direction to raise the abutment member 38 out of the path of the envelope E and cause the roller to engage the from wall 18 of the envelope E to press the back wall 16 thereof into driving engagement with the belt 48 to eject the envelope from the inserting machine 10.

Thus, it should now be apparent that there has been provided an extremely effective, yet relatively simple, collation feeding mechanism for feeding collations into an envelope and for ensuring that the collation is maintained under positive grip control of the feeding mechanism at all times until the entire collation is at or beyond the crease line between the front wall and flap of the envelope so that it is entirely within the envelope.

It is to be understood that the present invention is not to be considered as limited to the specific embodiment described above and shown in the accompanying drawings, which is merely illustrative of the best mode presently contemplated for carrying out the invention and which is susceptible to such changes as may be obvious to one skilled in the art, but rather that the invention is intended to cover all such variations, modifications and equivalents thereof as may be deemed to be within the scope of the claims appended hereto.

I claim:

1. An envelope inserting machine for inserting collations of varying thickness into successive envelopes fed seriatim to a predetermined inserting position and held thereat with the throat of the envelopes open, each envelope having a front wall, a back wall and a flap secured to the upper edge of the front wall along a crease line, said inserting machine comprising:

A. means for positioning successive envelopes at said predetermined inserting position with said crease line disposed at a predetermined location, B. means at said inserting position for opening the throat of each successive envelope fed to said inserting position, and C. rotary feeding means for feeding successive collations of varying thickness along a feed path to said inserting position and for inserting said collations into said envelopes while maintaining a grip on said collations until said collations are fully inserted into said envelopes with the trailing edge of said collations disposed at or beyond said crease line of said envelopes, whereby said collations will be fully inserted into said envelopes regardless of whether said collations consist of one or a plurality of sheets.

2. An envelope inserting machine as set forth in claim 1 wherein said rotary feeding means includes opposed cooperating rotary feed elements disposed adjacent said predetermined location of said crease line when an envelope is disposed in said predetermined inserting position for contacting opposite surfaces of a collation for gripping said collation therebetween until the trailing edge thereof is at or beyond said crease line.

3. An envelope inserting machine as set forth in claim 2 wherein said opposed cooperating rotary feed elements comprise A. an endless belt having a run portion extending along said feed path, and B. support means for supporting said run portion such that said run portion terminates adjacent said predetermined location of said crease line.

4. An envelope inserting machine as set forth in claim 3 wherein said opposed cooperating rotary feed elements further comprise rotary back up means for said run portion of said belt mounted in cooperating relationship with said run portion where said run portion terminates at said predetermined location of said crease line.

5. An envelope inserting machine as set forth in claim 4 wherein

A. said support means for supporting said run portion at said predetermined location of said crease line comprises a roller mounted for limited movement toward and away from rotary back up means, and B. means normally urging said roller toward said rotary back up means, whereby said termination point of said belt can yieldably move to accommodate collations of varying thickness.

6. An envelope inserting machine as set forth in claim 7 wherein said rotary back up means comprises a roller against which said run portion of said belt urges said collation in feeding engagement therewith, the axes of said back up roller and said belt supporting roller being in substantial alignment with each other adjacent said predetermined location of said crease line.

7. An envelope inserting machine as set forth in claim 1 wherein said rotary feeding means comprises A. a guide plate having a lower surface which defines said feed path along which said collations are fed to said inserting position, B. rotary feeding means disposed in adjacent operative association with said lower surface of said guide plate for feeding said collations along said lower surface of said guide plate, and C. rotary back up means mounted on said guide plate adjacent the downstream end thereof in cooperative relationship with said rotary feeding means for ensuring that said collations are fully inserted into said envelopes.

8. An envelope inserting machine as set forth in claim 7 wherein said rotary feeding means includes an endless feed belt mounted on a plurality of rollers such that said feed belt is disposed in adjacent cooperating relationship with said lower surface of said guide plate so that said feed belt feeds collations along said feed path, one of said rollers being mounted sufficiently close to said inserting position that the axis thereof is disposed adjacent to said predetermined location of said crease line.

9. An envelope inserting machine as set forth in claim 8 wherein said rotary back up means comprises a roller against which said endless belt urges said collation in feeding engagement therewith, the axes of said back up roller and said one belt mounting roller being in substantial alignment with each other adjacent said predetermined location of said crease line.

10. An envelope inserting machine as set forth in claim 9 wherein said rotary feeding means further includes A. support means for supporting said one belt mounting roller for limited movement toward and away from rotary back up means, and B. means normally urging said support means toward said rotary back up means, whereby said support means can yieldably move to accommodate collations of varying thickness.

* * * * *